United States Patent [19]

Price et al.

[11] 4,268,088

[45] May 19, 1981

[54] SHORTWALL MINING OF TRONA

[75] Inventors: Herbert S. Price; Glen E. Hunter, both of Green River, Wyo.

[73] Assignee: Texasgulf Inc., Stamford, Conn.

[21] Appl. No.: 80,271

[22] Filed: Oct. 1, 1979 (Under 37 CFR 1.47)

[51] Int. Cl.[3] ..... E21C 41/08

[52] U.S. Cl. ..... 299/11

[58] Field of Search ..... 299/11

[56] References Cited

U.S. PATENT DOCUMENTS

| | | | |
|---|---|---|---|
| 3,778,108 | 12/1973 | Pennington et al. | 299/11 |
| 4,030,752 | 6/1977 | Simpson | 299/11 |
| 4,127,303 | 11/1978 | Naka-Jima et al. | 299/11 |

*Primary Examiner*—Ernest R. Purser

*Attorney, Agent, or Firm*—Denis A. Polyn

[57] ABSTRACT

A method of mining substantially horizontal beds of trona ore, such as are found in the vicinity of the town of Green River, Wyoming, in which substantially all the ore within a given area is extracted. Mining is accomplished by driving substantially parallel entries into the trona formation approximately 100 to 200 feet apart, connecting the entries by at least one primary passage which thereby defines a trona panel, supporting the roof of the primary passage by movable roof supporting structures, and mining the exposed short face or wall of the trona panel. The mined material is removed and the roof supporting structures are advanced so that the structures remain essentially adjacent and parallel to the panel face being mined as it recedes. The roof supporting structures are continuously advanced incrementally to effect caving of the previously supported roof and facilitate mining of the exposed short face of the trona panel.

11 Claims, 8 Drawing Figures

SUPPORT MOVING SEQUENCE

Fig. 2A. BEFORE MINER BEGINS CUT

Fig. 2B. AS SOON AS MINER CUTS BY

Fig. 2C. AS SOON AS MINER RETREATS

Fig. 2D. CHOCK ADVANCE

Fig. 2E. FINAL POSITION FOR NEXT CUT

SHORTWALL MINING OF TRONA

BACKGROUND OF THE INVENTION

1. Field of the Invention

The rising economic and environmental cost of recovering natural resources has stimulated interest in utilizing methods of recovery to produce as little waste of the resources as possible without substantial increases in cost. Like other enterprises engaged in the extraction of mineral products, mining differs from manufacturing industries in that an increased productivity must inevitably result in a shortened mine life unless the increased productivity results from an improvement in recovery techniques. The invention relates to an improved method of mining trona mineral, such as is found in southwestern Wyoming and similar trona deposits situated elsewhere, with increased recovery of trona over conventional methods without substantial increase in cost.

2. Description of Prior Art

Trona mineral, or natural sodium sesquicarbonate, having the formula $$Na_2CO_3 \cdot NaHCO_3 \cdot 2H_2O$$

is presently mined in the United States from trona deposits located in southwestern Wyoming, in the general region of the town of Green River, Wyo. The Wyoming deposits were formed from residues of Gosuite Lake, which covered Wyoming for four million years during the early and middle Eocene age, approximately seventy million years ago. The Eocene age was marked with vast structural depressions and an inland advance of the sea. With increasing dessication over hundreds of thousands of years, the level of Gosuite Lake sank below its outlet to the sea, shrinking until it reached an area of approximately 1000 square miles and its brine content became so concentrated that beds of trona were deposited. Other major trona deposits are located in Kenya at Lake Magadi and in California near Searles Lake and Owens Lake.

The Wyoming trona deposits are evaporites, as hereinabove described, and hence form substantially horizontal layers. The beds vary greatly in thickness, from about 1 foot to about 16 feet. However, the beds are persistent and extend for about 1000 square miles, thus providing reserves adequate for reasonably forseeable future needs. The beds are located approximately 800 feet to approximately 2000 feet below ground surface. In particular, a main trona bed, averaging a thickness of about 8 feet to about 11 feet is located approximately 1200 feet to approximately 1600 feet below ground surface. The main bed is located below substantially horizontal layers of sandstones, siltstones and mainly unconsolidated shales. In particular, within about 400 feet above the main trona bed are layers of mainly weak, laminated green-grey shales and oil shale, interbedded with bands of trona from about 4 feet to about 5 feet thick. Immediately below the main trona bed lie substantially horizontal layers of somewhat plastic oil shale, also interbedded with bands of trona. Both overlying and underlying shale layers contain methane gas.

The comparative compressive strengths, in pounds per square inch, of the main trona bed and of the overlying and underlying shale layers in average values is substantially as follows:

Shale 3,700 p.s.i.
Trona 7,500 p.s.i.

Thus, both the immediately overlying and the immediately underlying layers are substantially weaker than the main trona bed. Recovery of the main trona bed, accordingly, essentially comprises removing the only strong layer within its immediate vicinity.

Presently, it is economical to recover from the Wyoming deposits only the trona located in the main trona bed. This recovery is presently achieved by underground mining. However, because the surrounding shale layers are substantially weaker than the main trona bed and because of the substantial depth at which the main trona bed is located, removal of the main trona bed will leave an essentially weak shale roof which is incapable of supporting itself over large spans. Special techniques have accordingly been devised to mine the trona bed and provide roof support for areas of active mining. No attempt is made to support the entire weight of the overlying materials, roof support in underground mining being generally designed only for the purpose of protecting areas of active mining; i.e., the roof is allowed to cave over mined out areas. These techniques are primarily designed to prevent the caving of the overlying shale layer into an area of active mining and to provide adequate ventilation due to the presence of methane gas in the surrounding shale layers, as hereinabove mentioned, which is released upon caving of the shale layers.

One technique generally used in mining the main trona bed in Wyoming, is the room and pillar system. In this system, trona is generally mined by driving a series of tunnels through the main trona bed in two directions at substantially right angles, so as to divide the bed into a number of blocks or pillars and generating a cellular (rooms) pattern. In particular, essentially rectangular tunnels are cut in the main trona bed, which tunnels are termed secondary entries. The vertical walls of the secondary entries form bases for support of the overburden and its pressure arch. The rectangular shape of the secondary entries, however, provides no support for the span of roof between the substantially vertical walls of the secondary entries. Accordingly, a substantial layer of trona, approximately 1 foot to 4 feet, is left adjacent the roof of the secondary entries. The roof is additionally supported by roof bolting and timbering. Substantially parallel rooms, which are about 15 feet wide and which are spaced about 50 to about 60 feet apart are driven into the main trona bed from the secondary entries, generally using a continuous mining machine. By use of the continuous mining machine, the rooms are elliptically shaped and conform to the pressure arch of the overburden. Accordingly, the roof span between the walls of the rooms is more adequately supported by leaving a layer of trona adjacent the roof of the room than the roof span in the secondary entries. Hence, less secondary support means such as roof bolting and timbering will be required for the rooms. The pillars of trona which remain between the parallel rooms are then extracted by driving tunnels, called lifts, through the pillars. The lifts are separated from the mined out area by a narrow wall or fender of trona, which fender is approximately 7 feet thick or less. When the lift is completed, the fender is removed by blasting and the resulting unsupported roof adjacent the previously mined area is caved. This caving relieves some of the overburden pressure within the pillar being mined. This sequence is repeated and, upon completion of one lift, the fender is blasted and the next parallel lift is begun.

As hereinabove mentioned, the primary disadvantage of any room and pillar system is that a substantial amount of the trona cannot be recovered but must remain to support the overburden. This unrecovered trona is generally left adjacent the roof and in the pillars. Further, as blasting is required to recover the fender, the roof supported by the trona layer and secondarily supported by roof bolting and timbering develops cracks and fissures, and unplanned caving very often results. The greater part of the fender ore is generally not recovered.

Another technique used in mining trona is the longwall mining system. In this system, the whole of the main trona bed within a specified area, called a panel, is extracted in one continuous operation by taking successive slices over the entire length of a long working face. No remnants of trona are left either to support the overburden or to serve as stress concentrators, such as the crushed supporting pillars mentioned hereinabove (while both blasting and crushing occur, they do not necessarily occur together). However, costly roof supporting structures must be used adjacent and parallel to the working face. The length of the trona face will usually be about 300 to about 500 feet, a length of about 300 feet often being considered necessary to achieve an output sufficient to justify the costs of this technique. Further, the machinery used in mining the face cannot be used in development of new mining areas.

In the longwall technique, two parallel tunnels are driven into the main trona bed, starting from the main haulage road of the mine at points approximately 300 feet to 500 feet apart, or however long the working trona face is to be. These parallel tunnels are termed gate roads and they are often driven at right angles to the main haulage road. As the gate roads are ultimately intended for use as transport, they are fairly large. After some distance has been advanced in both gate roads, a longwall trona face is opened up by driving a further tunnel, the height of the bed, between the remote ends of the gate roads. Trona is mined from the exposed longwall by use of either a double drum shearer loader or plow. The shearer or plow is pulled back and forth across the exposed longwall trona face, and loosened trona is dropped into a conveyor. Self-advancing hydraulic jacks or chocks support the roof and follow the plow or shearer as it slices into the trona bed. The hydraulic roof supports, whether chock or shield types, support the immediate roof and overlying layers. When advanced this support is removed and the weight of the overburden creates the fall necessary to remove the excess pressure at the exposed trona face, thereby providing protection from unplanned cavings. Furthermore, the hydraulic roof supports control the caved overburden, or gob, and segregates this caved material from the active working face. The mining can either proceed away from the main haulage road, in which case it would be termed advance longwall mining, or it can proceed towards the main haulage road, in which case it would be termed retreat longwall mining.

In particular, trona panels of about 2,000 feet to about 4,000 feet in length and about 300 feet in width have been successfully mined. In both retreat and advance mining, a waste area is left behind known as goaf or gob. The gob consists generally of the mined-out area in which the roof has collapsed once no longer supported by the self-advancing chocks. However, due to the length of the trona face being mined, it is quite often difficult to induce the initial cave and uneven caving may result, which places excessive weight on all or some of the supports. Further, the plow or shearer used to mine the exposed longwall cannot be used to develop new panels. Hence, the working of the longwall face and development of new panels must be properly spaced or else expensive machinery will be idled.

Another disadvantage associated with longwall mining of trona is cost. As hereinabove described, a typical longwall face is about 300 feet to 500 feet in length, and the practice has been usually to place supports approximately every three to five feet along the exposed trona face. These supports are very costly. Further, this usual length of longwall trona face is generally greater than the pressure arch of the overburden, and accordingly results in a tendency to overload the supports. Additionally, as hereinabove mentioned, the double drum shearer loader or plow cannot be used for development work, and so system development work must be properly paced or major pieces of equipment will be idled.

By the method disclosed herein, the problems associated with such prior art systems as the room and pillar system as well as the longwall mining system are overcome. Thus by the system described herein a more complete and effective recovery from the trona is accomplished. by mining the shorter face of the trona panel, more versatility of equipment results, fewer costly roof supporting structures are needed, and initial and unform caving is easier to achieve than in current practices. Additionally, more trona is recovered than in the predominantly used room and pillar mining of trona.

SUMMARY OF THE INVENTION

Briefly stated, the method of the present invention includes the steps of driving first and second entry ways into a trona bed to a distance of substantially equal lengths. The entry ways are spaced from one another a distance substantially less than the length of the respective entry ways. Further, the entry ways are spaced from one another a distance less than that of the pressure arc formed over the mined out cavity. The first and second entries are connected to one another by means of a passageway which defines the trona bed to be mined. In the preferred embodiment, the trona bed to be mined is of a substantially rectangular shape.

The upper section of the connecting passage means is supported adjacent the trona panel to be mined. The mined strip is of a length substantially less than that of said entry means and preferably is of a length between 100 to 200 feet. The trona bed is thus mined removing substantially the entire layer of trona without the drawbacks of the prior art methods.

Further in accordance with the present invention, the step of mining is conducted continuously in a single direction. More specifically, mining is conducted from the entry which serves as the intake airway in a direction toward the entry serving as the return airway. In this manner, the operator is away from the trona face which may be subject to spalling. Mining is accomplished by positioning a plurality of hydraulic support members immediately adjacent the strip of the trona bed to be mined with the support members being progressively advanced as mining advances.

Accordingly, it is an object of this invention to provide a method for mining trona ore in a substantially horizontal bed, such as trona ore found in the general vicinity of the town of Green River, Wyoming.

It is another object of this invention to achieve a high degree of mine productivity by substantially complete extraction of trona within a given area.

It is also an object of this invention to provide for the continuous mining of trona by a process which eliminates the need for blasting of fenders, and permits efficient and substantially complete removal of trona from the ore bearing beds.

Still another object of this invention is to provide an effective and efficient method of mining trona in which the costs are below those of existig methods.

These and other objects, advantages and features of the invention will become more apparent from the following description taken in conjunction with the accompanying drawings.

DESCRIPTION OF THE PREFERRED EMBODIMENT

Figure 1:
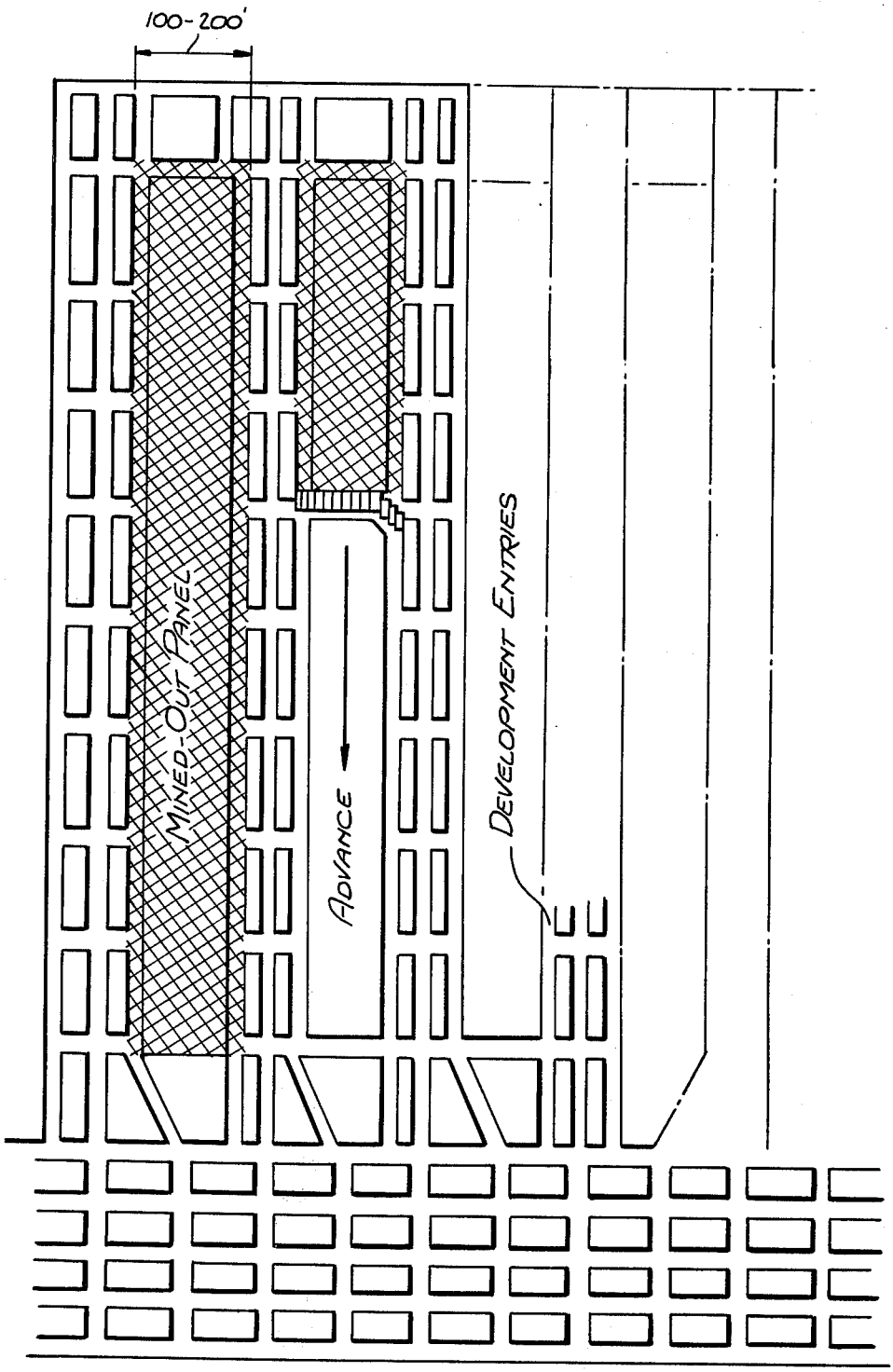
FIG. 1 is a plan view of a mine level illustrating the application of the present invention in the extraction of a trona panel as mining progresses.

The present invention utilizes a mining technique useful for extracting trona ore from substantialy horizontal beds of trona in which substantially parallel entries are driven into the trona bed approximately 100 feet to 200 feet apart, which entries are then connected by at least one primary passage thereby defining a trona panel to be mined. The roof of the primary connecting passage is supported by means of movable roof supporting structures positioned adjacent the exposed face of the trona panel to be mined. The roof supporting structures are advanced as the mining proceeds so that they remain essentially adjacent and parallel to the mined face as it recedes. The roof supporting structures are continuously advanced to incrementally effect spontaneous caving of the previously supported roof. As the entire exposed face is mined, more trona is recovered than in current room and pillar methods, which recover is further effected without blasting. As the trona face being mined is only about 100 feet to about 200 feet in length, less supporting structures are needed than are presently required in current longwall practice. Further, the trona face may be mined using the same equipment that was used to develop the entries and primary passage.

Referring now to the drawings which illustrate a preferred embodiment of the practice of the invention:

In FIG. 1, a mining pattern is depicted where the trona panel is formed between interconnected parallel entries. Thus, the mined out trona panel 10 is bounded by entries 20 and 21 while the trona panel 11 being mined is bounded by parallel entries 21 and 22. Similarly, the remaining trona panels 12 and 13 to be mined are bounded by entries 22–23 and 23–24 respectively. The entries are spaced from one another a distance of approximately 100 to 200 feet which is substantially less than that of the length of the entry. Each of the adjacent entries are interconnected by primary passage means 25 at one end and primary passage means 26 at the other end. The trona bed to be mined is thus rectangular with the short wall thereof extending approximately 100 to 200 feet, a distance which is less than that of the pressure arc ultimately formed over the mined out cavity.

As illustrated in FIG. 1, when mining of panel 10 was initiated, horizontal passages 25 and 26 were complete for their full length and the roof therein supported. Adjacent passage 25 and immediately beneath the support for the roof section therein, the exposed shortwall of trona, representing the short side of trona panel 10, was mined along its entire length. The mining of trona panel 10, therefore, proceeded in a direction from passage 25 to passage 26, and the roof supporting structures, were made to follow the receding shortwall in the same direction, to thus continuously protect the active mining area. Entries 20–24 and passages 25 and 26 are preferably substantially as high as the thickness of the trona bed being mined. Also, the cross-cuts in FIG. 1, which define roof supporting pillars 14 are likewise substantially as high as the thickness of the trona bed being mined. Entries 20–24, the cross-cuts and passages 25 and 26 are used for ventilation, haulage of mined trona from the active mining area and for the movement of men and equipment.

Because of the weakness of the overlying roof, once unsupported the roof spontaneously caves thus filling the area behing the roof supporting structure as it moves in the direction of mining.

As further illustrated in FIG. 1, in the trona panel 11 being mined the roof supporting structures consist of a plurality of adjacently spaced movable hydraulic support members 30 which are moved in the direction of the arrow as the mining advances. Roof supporting members 30 are spaced approximately 3 feet to 5 feet apart. The cross-hatched area of trona panel 11, therefore, is the mined area the roof of which has spontaneously and progressively collapsed as roof supporting members 30 have been moved in direction of the arrow. As mining continues in direction of arrow, the entire trona panel 11 will be mined and the space left thereby will have been filled incrementally as a result of the progressive and spontaneous collapse of the roof.

Figure 3:
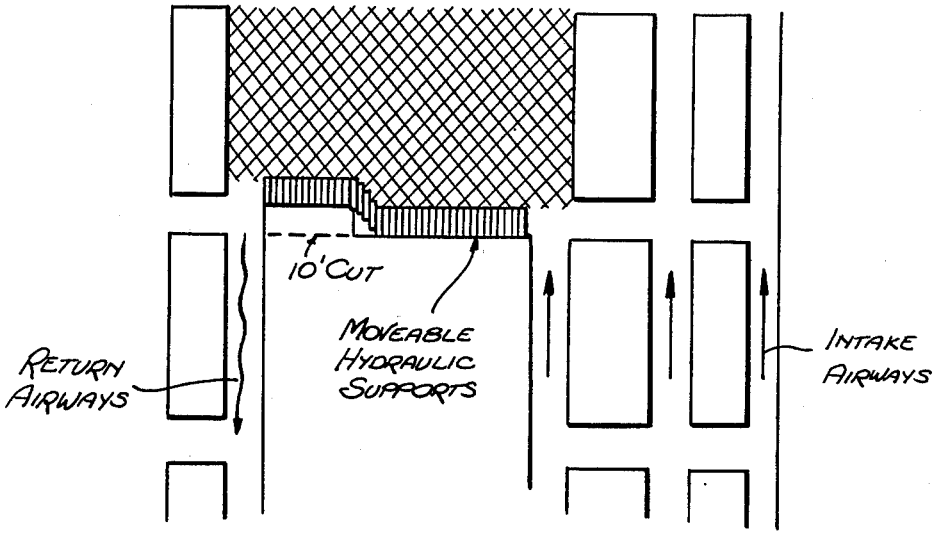
FIG. 3 is an enlarged plan view of the mine level illustrating the manner of mining the trona panel.

With reference to FIG. 3, the positioning of the movable hydraulic support members 30 is illustrated with reference to the advancement of the miner. Mining which is performed in a single direction commences at entry 22 and progresses towards entry 21 the former of which (22) constitutes the intake airway while the latter (21) serves as the return airway. In this manner, the miner advances into the trona face from the same direction each time, thus keeping the operation away from the trona face which may be subject to spalling. Further, better ventilation is provided since the miner operator is never "down-wind" of the cutter head.

Figure 4:
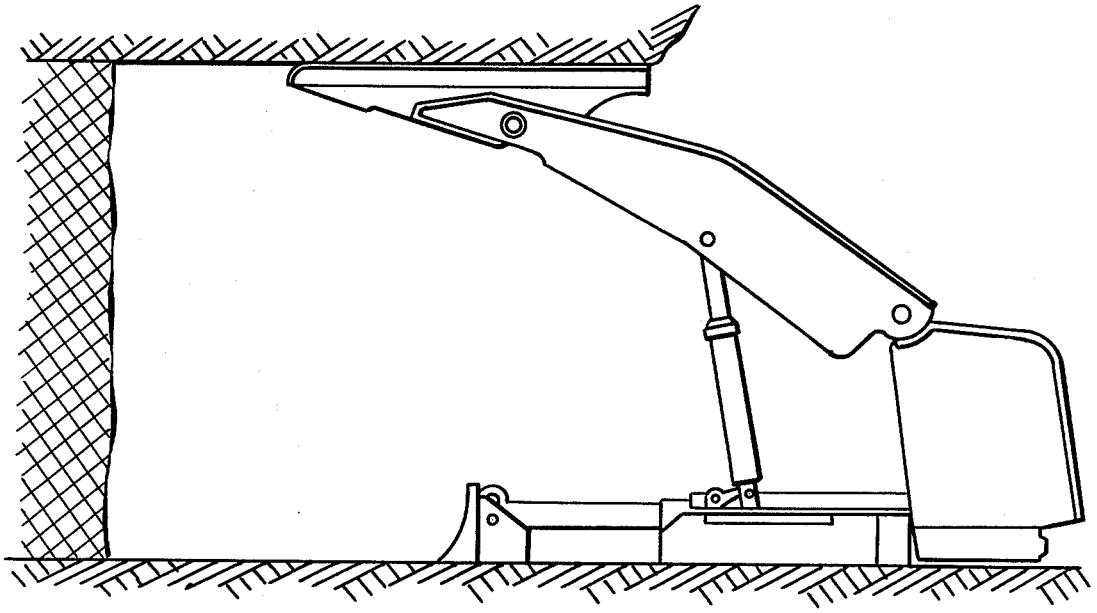
FIG. 4 is an enlarged side elevation view, partially in cross-section, depicting the hydraulic roof support engaging the upper shale roof.

As the miner progresses making a 10 foot cut as depicted in FIG. 3, support members 30 are progressively withdrawn until they reach the position for the next cut. FIG. 4 is an enlarged section illustrating one type of movable roof supporting member 30. Other types such as those more fully described hereinafter are also suitable. Support member 30 of FIG. 4 has been advanced adjacent the exposed face of trona panel 11. Overlying shale 40 and underlying shale 41 are shown, between which trona panel 11 to be mined is sandwiched.

Figure 2:
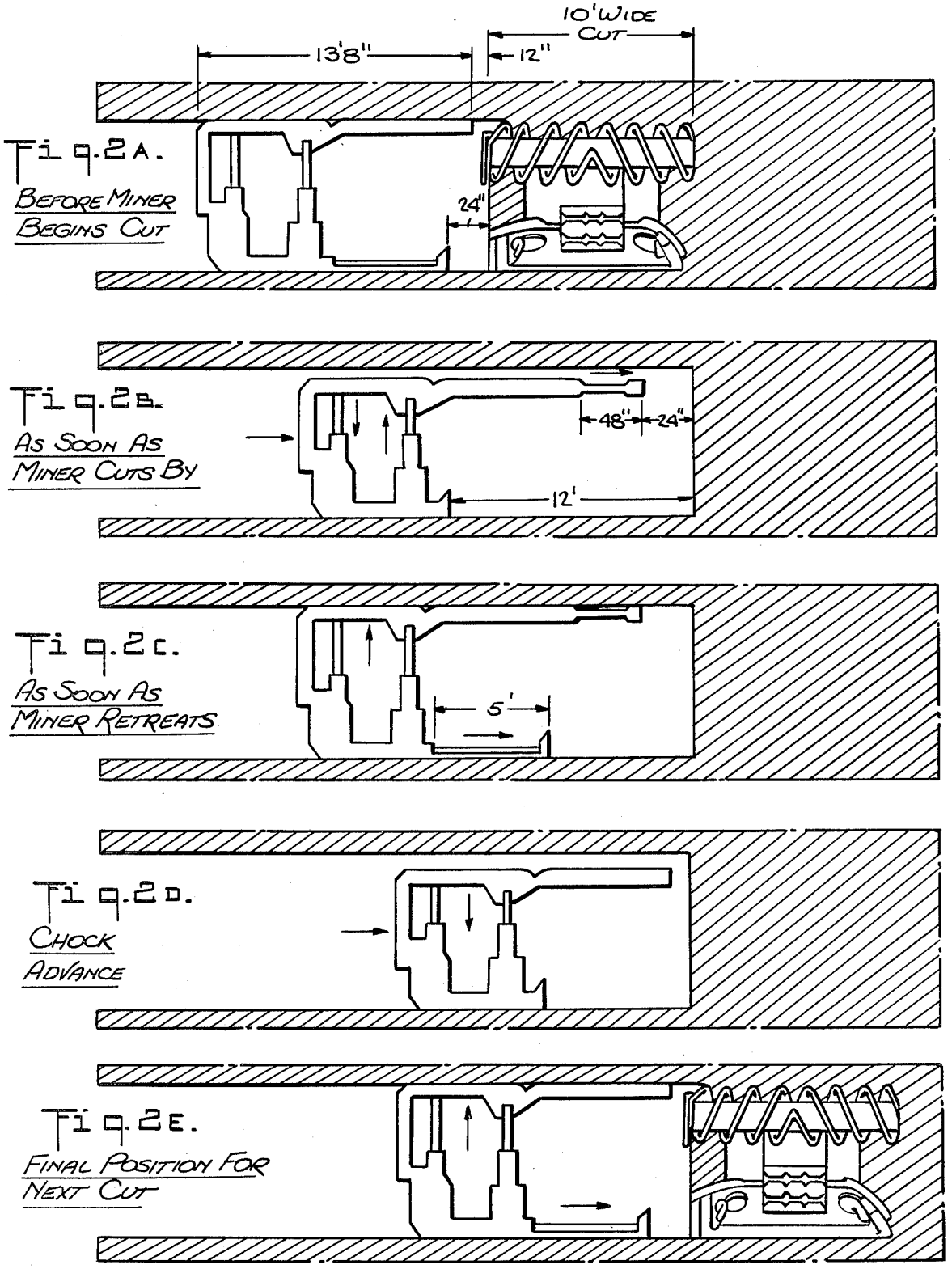
FIGS. 2A through 2E are side elevation views, partially in cross-section, depiciting the sequential advancement of the hydraulic support member.

Movement of hydraulic support member 30 with respect to the operation of the miner 31 is illustrated in FIGS. 2A–E. Prior to cutting the short face of trona panel 11, the width of the cut as illustrated being 10 feet, hydraulic support member 30 has the upper arm 32 and lower support 33 in the extended position. Support member 30 remains in this position during the cutting step (FIGS. 2A and E). As soon as miner 31 makes the cut, support member 30 is advanced and forepole 34 is extended from upper arm 32 which was lowered away from upper shale 40 and lower support 33 is retracted (FIG. 2B). As soon as miner 31 retreats, upper arm 32 with forepole 34 extended is brought into engagement with upper shale 40 and lower support 33 is fully extended (FIG. 2C). Once miner 31 has sufficiently advanced, upper arm 32 is again withdrawn from supporting upper shale 40 and lower support 33 is withdrawn thus allowing the member 30 to advance (FIG. 2D) into position for the next cut (FIG. 2E).

The method of the present invention offers several advantages over both the room and pillar methods and longwall method presently being employed. All of the trona within a given area or panel is extracted and no pillars or roof supporting layers need be left behind. The need for secondary supports such as roof bolting and timbering is eliminated, and the hazards of blasting avoided. Methane gas which is generally released in large volumes upon the collapse of a large roof area as in room and pillar mining is released slowly using this method, as incremental caving is employed. Because the trona face being mined is not as long as faces presently mined using the longwall technique, less support problems are presented and the hazard of overburdening the support members is better avoided.

While a preferred embodiment of the invention has been provided for the purpose of the disclosure, other modifications and variations may be made without departing from the spirit and scope of the invention.

What is claimed is:

1. A method of extracting trona ore from an underground formation which includes a trona bed located between layers of shale comprising the steps of:

(a) driving a first entry into said trona bed to a predetermind length, (b) locating a second entry from said first entry at a distance less than that of the pressure arc that forms over the mined out cavity and at a distance substantially less than the length of said first entry, (c) driving a second entry into said trona bed substantially parallel to said first entry to a predetermined length substantially equal to that of said first entry, (d) connecting said first and second entries with a passage means thereby defining the trona bed to be mined, (e) supporting the upper section of said connecting passage means generally adjacent the path of said trona bed to be mined, (f) mining a strip of said trona bed between said first and second entries in a direction substantially parallel to said connecting passage and removing the recovered trona ore from the underground formation, and (g) repeating said steps (e) and (f) until said defined trona bed is substantially mined.

2. The method according to claim 1 wherein said trona bed to be mined comprises a substantially rectangular panel.

3. The method according to claim 1 wherein said second entry is located from said first entry a distance of approximately 100 to 200 feet.

4. The method according to claim 1 wherein said step of mining a strip of said trona bed is performed in a single direction.

5. The method according to claim 4 wherein said single direction mining is in a direction commencing adjacent the intake airway and moving towards the return airway.

6. The method according to claim 1 which further includes the step of forming a roof supporting pillar within said first and second entries adjacent said trona bed to be mined.

7. The method according to claim 1 wherein said steps (e) and (f) comprise:

(h) positioning a plurality of support members adjacent the path of said trona bed to be mined to support the upper layer of shale, (i) mining a strip of said trona bed adjacent said support member, (j) lowering the support member out of contact with said upper layer of shale after said mining step, (k) advancing said support member into the area of said trona bed which was previously mined and spacing said support adjacent the next area to be mined, and (l) raising said support member into position to support the upper layer of shale during the next mining step.

8. The method according to claim 1 wherein said steps (e) and (f) comprise:

(m) positioning a hydraulic support member adjacent the path of said trona bed to be mined with the lower portion of said support member extending from the main body in contact with the lower layer of shale, (n) mining the strip of said trona bed adjacent said hydraulic support member, (o) lowering said hydraulic support out of contact with said upper layer of shale and withdrawing said lower support extension, (p) advancing said support member with an extended upper support arm into the area previously mined, (q) raising the upper portion of said hydraulic support with the upper arm extended into contact with the upper layer of shale as the miner passes, (r) lowering the hydraulic support out of contact with said upper layer of shale and withdrawing the extended portion of said upper arm support and said lower support extension, (s) advancing said hydraulic support into a position immediately adjacent the next area of said trona bed to be mined, and (t) raising said upper support into contact with said upper layer of shale and advancing said lower support extension into position for mining the next strip of said trona bed.

9. A method of extracting trona ore from an underground formation which includes a trona bed located between layers of shale comprising the steps of:

(a) driving a first entry into said trona bed to a predetermined length, (b) locating a second entry from said first entry at a distance less than that of the pressure arc that forms over the mined out cavity and at a distance substantially less than the length of said first entry, (c) driving a second entry into said trona bed substantially parallel to said first entry to a predetermined length substantially equal to that of said first entry, (d) connecting said first and second entries with a passage means thereby defining the trona bed to be mined, (e) supporting the upper section of said connecting passage means generally adjacent the path of said trona bed to be mined, (f) mining a strip of said trona bed between said first and second entries by continuously advancing a mining machine in a direction from the entry forming the intake airway to the entry forming the return airway, and (g) repeating said steps (e) and (f) until said defined trona bed is substantially mined.

10. The method according to claim 9 wherein said trona bed to be mined comprises a substantially rectangular panel.

11. The method according to claim 9 wherein said second entry is located from said first entry a distance of approximately 100 to 200 feet.

* * * * *